US005370230A

United States Patent [19]

Cox

[11] Patent Number: 5,370,230

[45] Date of Patent: Dec. 6, 1994

[54] CONTAINER AND METHOD FOR STORING CHILDREN'S CLOTHES

[76] Inventor: Lisa C. Cox, 1017 Robin Hood La., Norman, Okla. 73072

[21] Appl. No.: 976,867

[22] Filed: Nov. 16, 1992

[51] Int. Cl.[5] ..... B65D 33/04; B65D 33/14; B65D 30/22; B65D 85/18

[52] U.S. Cl. ..... 206/527; 206/281; 383/23

[58] Field of Search ..... 383/23; 206/278, 279, 206/287, 527, 281; 190/110, 902

[56] References Cited

U.S. PATENT DOCUMENTS

| | | | |
|---|---|---|---|
| 791,598 | 6/1905 | Woodland | 383/23 X |
| 1,141,690 | 6/1915 | Comingore | 206/287 |
| 1,320,869 | 11/1919 | Kinsey | 206/287 |
| 1,564,930 | 12/1925 | Boyes | 383/23 |
| 1,651,706 | 12/1927 | Holbrook | 206/287 |
| 1,967,584 | 7/1934 | McKenna | 206/278 X |
| 2,288,867 | 7/1942 | Meyer et al. | 206/279 |
| 2,308,375 | 7/1945 | Axelrod | 206/281 |
| 2,635,797 | 4/1953 | Siebert | 383/23 X |
| 2,704,098 | 3/1955 | Popock | 383/23 |
| 2,710,638 | 6/1955 | Ford | 383/23 |
| 2,751,071 | 6/1956 | Goldband | 383/23 X |
| 3,139,133 | 6/1964 | Spector | 383/23 X |
| 3,275,128 | 9/1966 | Neely | 206/281 |
| 3,559,777 | 2/1971 | Gardner | 206/279 |
| 3,704,778 | 12/1972 | Raschdorf | 206/287 |
| 3,834,497 | 9/1974 | Furst | 206/287 X |
| 3,929,224 | 12/1975 | Smith, Jr. | 383/23 X |
| 4,580,667 | 4/1986 | Herwood | 383/23 X |
| 4,947,987 | 8/1990 | Keenan | 383/23 X |
| 4,971,194 | 11/1990 | Inagaki | 206/278 X |
| 5,064,864 | 11/1991 | Schmitt | 383/23 X |

FOREIGN PATENT DOCUMENTS

| | | | |
|---|---|---|---|
| 24306 | of 1909 | United Kingdom | 206/278 |
| 268564 | 4/1927 | United Kingdom | 383/23 |
| 325371 | 2/1930 | United Kingdom | 190/902 |

*Primary Examiner*—Sue A. Weaver
*Attorney, Agent, or Firm*—Dunlap, Codding & Lee

[57] ABSTRACT

A container and method for storing children's clothes. The method including the step of providing at least five (5) children's storage containers with each storage container being adapted to hold children's clothing items and being removably hangable on a bar such as a rod in a closet. Each storage container comprises a wall assembly which at least partially encloses a clothing retaining space with a portion of the wall assembly defining an upper end opening providing access to the clothing retaining space. The clothing retaining space in each of the storage containers is sized and adapted for removably holding one outfit comprising children's clothing items. At least a portion of the wall assembly is transparent so that the clothing items in the clothing retaining space of each storage container are visible through the transparent portion of the wall assembly.

12 Claims, 3 Drawing Sheets

CONTAINER AND METHOD FOR STORING CHILDREN'S CLOTHES

FIELD OF THE INVENTION

The present invention relates generally to containers and, more particularly, but not by way of limitation, to children's storage containers for holding children's clothing items where each storage container is adapted to hold children's clothing items consisting of an outfit and wherein each storage container is removably hangable on a bar such as a bar in a closet.

DESCRIPTION OF THE PREFERRED EMBODIMENTS

Figure 1:
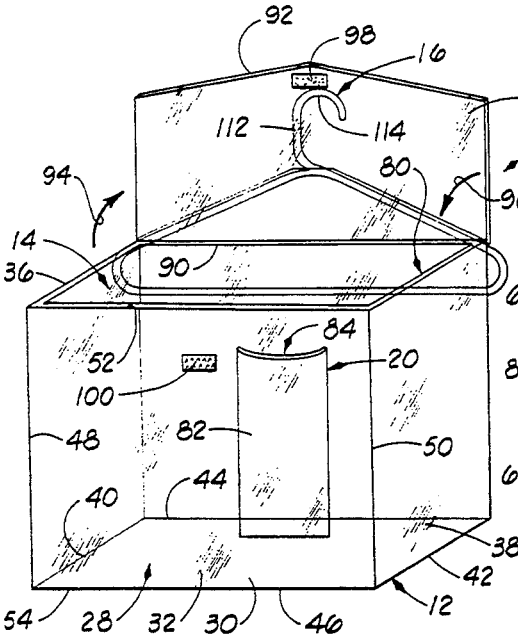
FIG. 1 is a perspective view of a children's storage container constructed in accordance with the present invention showing the closure flap in the opened position.
Figure 2:
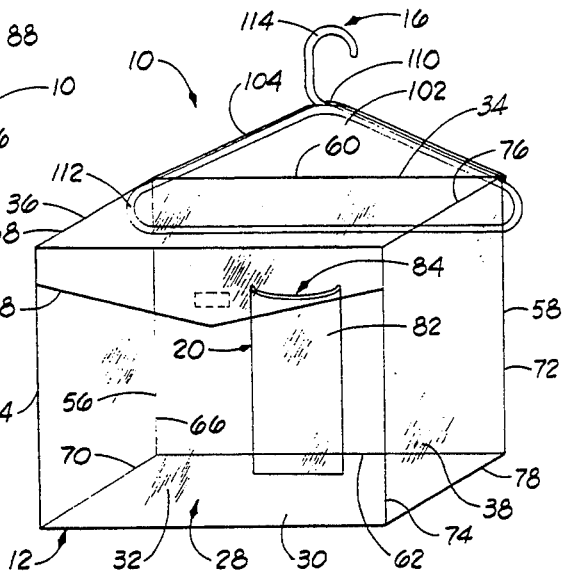
FIG. 2 is a perspective view, similar to FIG. 1, except showing the closure flap of the children's storage container in the closed position.
Figure 3:
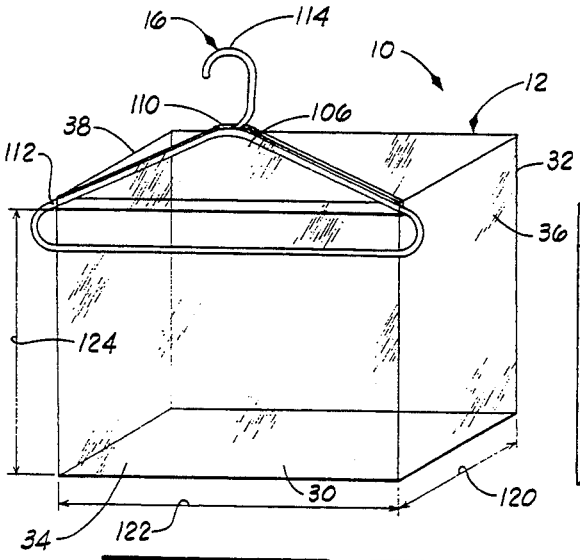
FIG. 3 is a perspective view of the children's storage container of FIGS. 1 and 2, showing the back side and showing the closure flap in the closed position.

Referring to the drawings in general, and to FIGS. 1, 2 and 3 in particular, shown therein and designated by the general reference numeral 10 is a children's storage container constructed in accordance with the present invention. The children's storage container 10 comprises a wall assembly 12 which at least partially encloses a clothing retaining space 14 (FIG. 1) and a connector assembly 16 for removably hanging the children's storage container 10 on a bar 18 (FIG. 5) such as a bar typically found in a clothes closet for example.

The clothing retaining space 14 is sized to removably retain a single outfit comprising children's clothing items. For example, a child's shirt, pants and underwear may be disposed in the clothing retaining space 14 and these clothing items would comprise the outfit sufficient to dress the child at the beginning of the day for example. The child's socks also may be disposed in the clothing retaining space 14. However, the children's storage container 10 preferably includes a pocket 20 (FIGS. 1 and 2) connected to the wall assembly 12 so that the child's socks and accessories such as hair clips can be removably disposed in the pocket 20. The socks and accessories comprise a portion of the children's clothing items and cooperate with the clothing items in the clothing retaining space 14 to comprise the single outfit.

Figure 4:
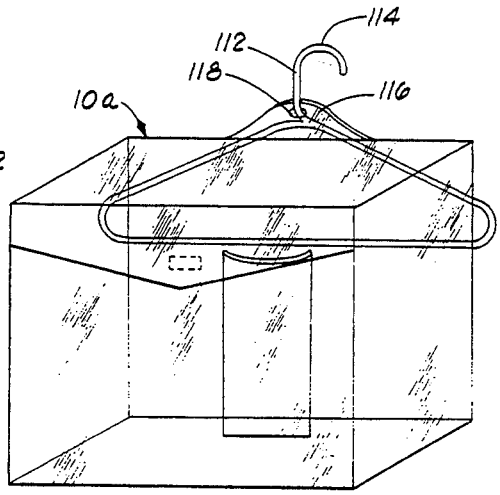
FIG. 4 is a perspective view of a modified children's storage container.
Figure 5:
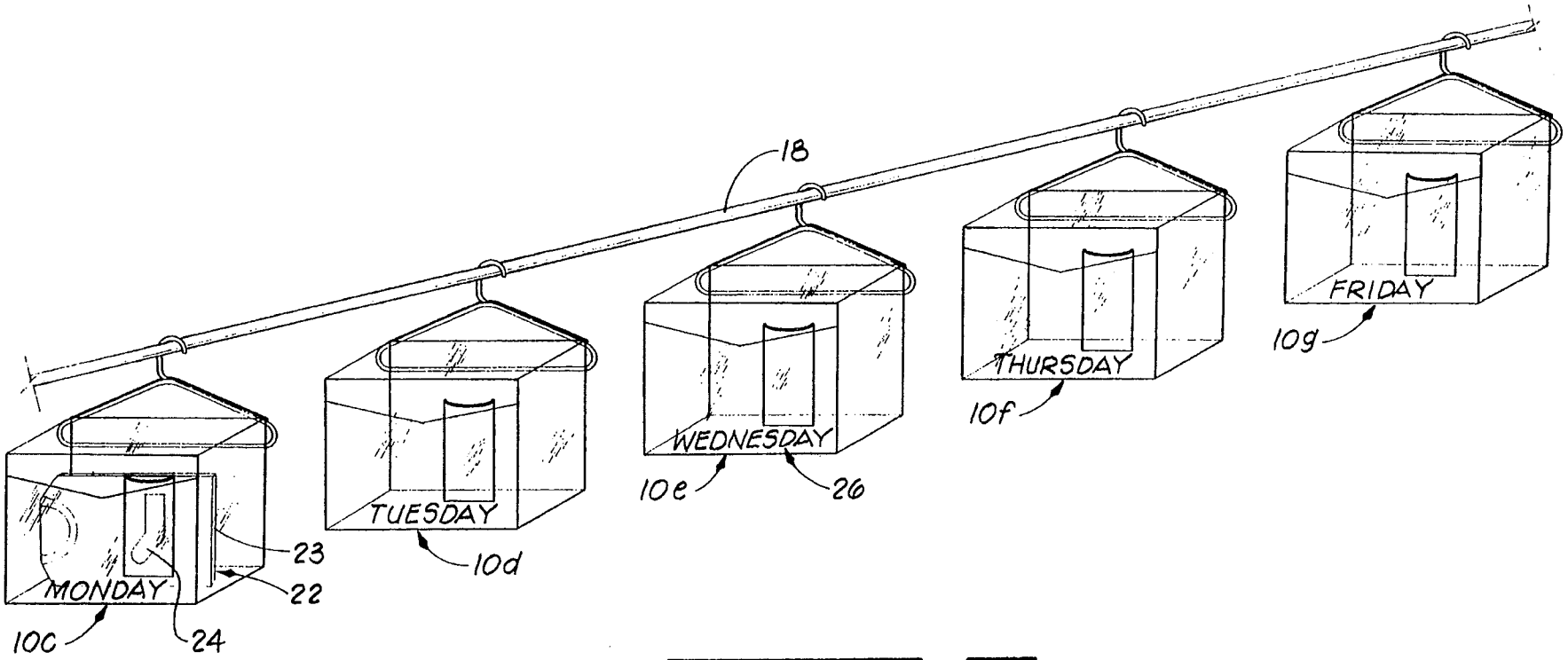
FIG. 5 is a diagrammatic view showing a plurality of children's storage containers removably hung on a bar, five children's storage containers being shown in FIG. 5 removably hung on the bar.
Figure 3:
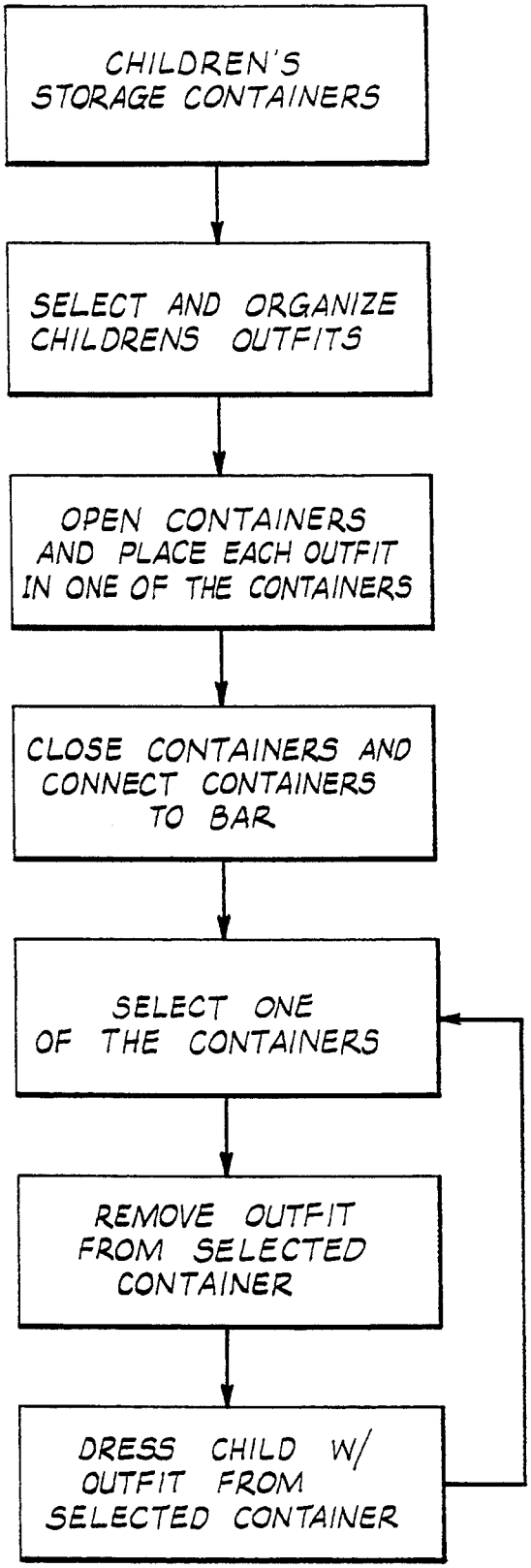

In use, the present invention contemplates a plurality of children's storage containers 10 and preferably between five and seven children's storage containers 10 with five children's storage containers 10 being shown in FIG. 5 and designated therein by the respective reference numerals 10*c*, 10*d*, 10*e*, 10*f* and 10*g*. The particular children's storage containers 10*c*, 10*d*, 10*e*, 10*f* and 10*g* may be constructed exactly like the children's storage container 10 shown in FIGS. 1, 2 and 3 or like the children's storage container 10*a* shown in FIG. 4.

In the instance illustrated in FIG. 5 for example, an individual would select five different outfits consisting of children's clothing items such as, one outfit for each day of the week. Each outfit then would be placed in one of the children's storage containers 10*c*, 10*d*, 10*e*, 10*f* or 10*g*. The clothing items are shown diagrammatically in FIG. 5 in the children's storage container 10*c* and designated therein with the general reference numeral 22. Shown in FIG. 5 is a shirt 23 disposed in the clothing retaining space 14 and a sock 24 disposed in the pocket 20 for the purpose of illustration. It again is to be understood that other items such as underwear and pants may be disposed in the clothing retaining space 14 and additional items such as accessories may be disposed in the pocket 20 if desired in a particular application.

The children's storage containers 10 then are removably hung on the bar 18 such as a bar typically found in a clothes closet. Each morning during the week, the child selects one of the children's storage containers 10*c*, 10*d*, 10*e*, 10*f* or 10*g* and that selected storage container is removed from the bar 18. The children's clothing items 22 then are removed from the children's storage container 10 and the child uses the removed children's clothing items 22 to dress for that particular day.

As shown in FIG. 5, each of the .children's storage containers 10 includes a day indicia 26 printed or disposed on the wall assembly 12 (only the day indicia 26 associated with "Wednesday" is designated with a specific reference numeral in FIG. 5). As illustrated in FIG. 5, the day indicia 26 is the particular day of the week namely, Monday, Tuesday, Wednesday, Thursday and Friday. However, the day indicia 26 also could be a color or any other suitable symbol for separately or individually and uniquely identifying each of the children's storage containers 10*c*, 10*d*, 10*e*, 10*f* and 10*g*.

The pre-selection of the outfits for each day of the week, eliminates the time consuming and sometimes painful task of working with the child each morning to select an outfit for that morning while simultaneously attending to the other chores necessary for getting the child ready to go to preschool or school and, in some instances, while the individual also is getting ready for work outside the home or inside the home. The day indicia 26 also permits the child some degree of selection if desired by the individual in that the child can select any one of the children's storage containers 10 for any given day and it is not necessary that the children's storage container 10 designated with the day indicia Monday actually be utilized on a Monday, for example.

At least a portion of the wall assembly 12 is transparent to form a transparent portion 28 (FIGS. 1 and 2). In this manner, the children's clothing items 22 in the clothing retaining spaces 14 are visible via the transparent portions 28 to assist the child in selecting an outfit for any given day.

Referring again to FIGS. 1, 2 and 3, the wall assembly 12 of the children's storage container 10 more particularly comprises a bottom panel 30, a front panel 32, a rear panel 34, a first end panel 36, and a second end panel 38. The panels 30, 32, 34, 36 and 38 are interconnected to form a generally rectangularly shaped wall assembly 12 with the panels 30, 32, 34, 36 and 38 cooperating to at least partially enclose the clothing retaining space 14.

The bottom panel 30 preferably is rectangularly shaped. As shown in FIG. 1, the bottom panel 30 has a first end 40, a second end 42, a first side 44, and a second side 46.

As shogun in FIG. 1, the front panel 32 has a first end 48, a second end 50, a first side 52, and a second side 54. The second side 54 of the front panel 32 is secured to the second side 46 of the bottom panel 30. The front panel 32 extends a distance upwardly at an angle of about ninety degrees from the bottom panel 30.

As shown in FIG. 2, the rear panel 34 has a first end 56, a second end 58, a first side 60, and a second side 62. The second side 62 of the rear panel 34 is connected to the first side 44 of the bottom panel 30. The rear panel 34 extends a distance upwardly at an angle of about ninety degrees from the bottom panel 30.

As Shown in FIG. 2, the first end panel 36 has a first end 64, a second end 66, a first side 68, and a second side 70. The second side 70 of the first end panel 36 is connected to the first end 40 of the bottom panel 30. The first end panel 36 extends a distance upwardly at an angle of about ninety degrees from the bottom panel 30. The second end 66 of the first end panel 36 is connected to the first end 56 of the rear panel 34. The first end 64 of the first end panel 36 is connected to the first end 48 of the front panel 32.

As shown in FIG. 2, the second end panel 38 has a first end 72, a second end 74, a first side 76, and a second side 78. The second side 78 of the second end panel 38 is connected to the second end 42 of the bottom panel 30. The second end panel 38 extends a distance upwardly at an angle of about ninety degrees from the bottom panel 30. The first end 72 of the second end panel 38 is connected to the second end 58 of the rear panel 34. The second end 74 of the second end panel 38 is connected to the second end 50 of the front panel 32.

In one preferred form, the bottom panel 30, the front panel 32, the rear panel 34, the first end panel 36 and the second end panel 38 can be integrally constructed from a single piece of material. Preferably, the bottom panel 30, the front panel 32, the rear panel 34, the first end panel 36, and the second end panel 38 each are constructed of a transparent material so that the clothing retaining space 14 is visible through the panels 30, 32, 34, 36 and 38. In this embodiment, each of the panels 30, 32, 34, 36 and 38 comprise the transparent portion 28. In an alternate embodiment, at least a portion of the front panel 32 is constructed of a transparent material so that the clothing retaining space 14 is visible through the transparent portion of the front panel 32 with the transparent portion of the front panel 32 comprising the transparent portion 28.

The panels 30, 32, 34, 36 and 38 are interconnected to form a generally rectangularly shaped children's storage container 10 with the first sides of the panels 32, 34, 36 and 38 being disposed in about a common plane forming an open upper end 80 (FIG. 1) of the children's storage container 10. The clothing retaining space 14 is accessible via the open upper end 80.

A pocket panel 82 (FIGS. 1 and 2) is connected to the front panel 32 along three sides of the pocket panel 82 forming a pocket opening 84 (FIGS. 1 and 2) between the fourth side of the pocket panel 82 and a portion of the front panel 32. The pocket opening 84 provides access to a pocket retaining space disposed between the pocket panel 82 and a portion of the front panel 32. The pocket panel 82 cooperates with a portion of the front panel 32 to form the pocket 20. Preferably, the pocket panel 82 is constructed of a transparent material so that the pocket retaining space is visible through the pocket panel 82 with the pocket panel 82 comprising a portion of the transparent portion 28.

The children's storage container 10 also includes a closure flap 88 (FIGS. 1 and 2). The closure flap 88 has a first end 90 (FIG. 1), and a second end 92 (FIG. 1). The first end 90 of the closure flap 88 is hingedly connected to the first side 60 of the rear panel 34 so that the closure flap 88 is movable in an open direction 94 (FIG. 1) and a close direction 96 (FIG. 1).

A flap connector 98 (FIG. 1) is connected to the closure flap 88 near the second end 92 of the closure flap 88. A wall connector 100 (FIG. 1) is connected to the front panel 32 and disposed generally between the first and the second ends 48 and 50 of the front panel 32.

The closure flap 88 is movable in the open direction 94 to the opened position as shown in FIG. 1 wherein the clothing retaining space 14 is accessible via the open upper end 80 of the children's storage container 10. The closure flap 88 is movable in the close direction 96 to a position wherein the closure flap 88 substantially encompasses and closes the open upper end 80 of the children's storage container 10 and, in this position, the flap connector 98 is engagable with the wall connector 100 for securing the closure flap 88 in the closed position. The flap connector 98 and the wall connector 100 may be constructed of a material such as a Velcro® material for example.

A first hanger flap 102 (FIG. 2) is connected to the first side 60 of the rear panel 34. The first hanger flap 102 extends a distance outwardly from the first side 60 of the rear panel 34 terminating with an outer edge 104 (FIG. 2). A second hanger flap 106 (FIG. 3) is connected to the outer edge 104 of the hanger flap and the second hanger flap 106 and the first hanger flap 102 cooperate to partially encompass a hanger retaining space. A hanger opening 110 (FIGS. 2 and 3) is formed through the first hanger flap 102 or, more particularly, formed between the first hanger flap 102 and the second hanger flap 106.

A conventional clothes hanger 112 having a hook 114 is partially disposable in the hanger retaining space with the hook 114 extending through the hanger opening 110. The hook 114 cooperates with the clothes hanger 112 to provide the connector assembly 16.

In some instances, it may not be desirable to dispose all of the children's clothing items 22 in the clothing retaining space 14 and or the pocket retaining space. For example, a dress or a dress shirt might be wrinkled if disposed in the clothing retaining space 14. In this instance, the dress shirt or the dress may be hung in a conventional manner from the clothes hanger 112 with the remaining clothing items being disposed in the clothing retaining space 14 and the children's socks or accessories or both being disposed in the pocket retaining space.

Shown in FIG. 4 is a modified children's storage container **10*a* which is constructed exactly like the children's storage container 10 shown in FIGS. 1, 2 and 3 and described in detail before, except the children's storage container 10*a* includes a modified hanger flap 116. In this embodiment, the hook 114 of the clothes hanger 112 is inserted through a hanger opening 118. The hanger flap 116 is connected to the first side 60 of the rear panel 34 and disposed generally between the first and the second ends 56 and 58 of the rear panel 34**.

Referring again to FIG. 3, the panels 30, 32, 34, 36 and 38 are interconnected to provide the children's storage container 10 or 10*a* having a width 120 (FIG. 3), a length 122 (FIG. 3) and a height 124 (FIG. 3). In a preferred embodiment, the width 120 is in a range from about two and one-half inches to about four inches. The length 122 is in a range from about twelve inches to about eighteen inches. The height 124 is in a range from about five inches to ten inches. The sizes or dimensions just mentioned are sized so that the clothing retaining space 14 is sufficient only to retain one outfit.

The use of the word "children" as used herein is intended to mean a human from the age of about birth to about twelve years old.

The children's storage containers 10 or 10*a* are intended to be sold in sets of five to seven children's storage containers 10 or 10*a*. Each of the storage containers 10 or 10*a* is sized to accommodate a single outfit of children's clothing items 22. The sets of children's storage containers 10 or 10*a* thus provides a children's clothes organizer intended to organize a child's clothing for each day of a week so that the child easily can find the child's clothes each morning. This greatly reduces time and stress involved in getting a young child dressed and to day care or to school.

As mentioned before, an individual with or without the child's assistance would select five to seven different outfits consisting of children's clothing items 22 and each outfit would be removably stored in one of the children's storage containers such as the children's storage containers 10*c*, 10*d*, 10*e*, 10*f* and 10*g* shown in FIG. 5. The children's clothing items 22 consisting of shirts, underwear and pants would be removably disposed in the clothing retaining spaces 14 of the respective children's storage containers 10*c*, 10*d*, 10*e*, 10*f* and 10*g*. Each outfit also would include socks and perhaps accessories and the socks and accessories would be removably stored in the respective pocket retaining spaces of the respective children's storage containers 10*c*, 10*d*, 10*e*, 10*f* and 10*g*. In some instances, a dress shirt or skirt may be hung on the clothes hanger 112 in the conventional manner rather than including the dress or dress shirt in the clothing retaining spaces 14 to prevent wrinkling of the dress or dress shirt if desired in a particular instance.

While disposing the clothing items 22 and the children's storage containers 10*c*, 10*d*, 10*e*, 10*f* and 10*g*, the closure flap 88 is first moved to the opened position by disconnecting the flap connector 98 and the wall connector 100 and moving the closure flap 88 in the open direction 94 to the opened position shown in FIG. 1. In the opened position of the closure flap 88, the children's clothing items 22 are disposed in the clothing retaining space 14 or the pocket retaining space of the pocket 20.

After the children's clothing items 22 have been disposed in the clothing retaining space 14 and the pocket retaining space of the pocket 20, the closure flap 88 is moved in the close direction 96 to the closed position wherein the closure flap 88 encompasses and closes the open upper end 80 and a portion of the closure flap 88 near the second end 92 thereof extends over a portion of the front panel 32 and over a portion of the pocket 20 with a portion of the closure flap 88 encompassing and closing the pocket opening 84. In this closed position of the closure flap 88, the flap connector 98 is removably connected to the wall connector 100 for securing the closure flap 88 in the closed position.

A dress or dress shirt then may be hung on any one or all of the clothes hangers 112. The hooks 114 of each of the clothes hangers 112 then are inserted through the hanger opening 110 or 118 of each of the children's storage containers 10*c*, 10*d*, 10*e*, 10*f* and 10*g*. The clothes hangers 112 With the wall assemblies 12 connected thereto then are removably hooked on the bar 18. In this position, the children's clothing items 22 in the clothing retaining spaces 14 and the pocket retaining spaces of the children's storage containers 10*c*, 10*d*, 10*e*, 10*f* and 10*g* are visible through the transparent portion 28 of the wall assembly 12 and the pocket panel 82 of the pocket 20.

Each morning, the individual or the child or the child with the assistance of the individual then selects the outfit to be worn that day by viewing the children's clothing items 22 in the children's storage containers 10*c*, 10*d*, 10*e*, 10*f* and 10*g* hung on the bar 18. After selection, the selected children's storage container 10*c*, 10*d*, 10*e*, 10*f* or 10*g* then is removed from the bar 24 and the closure flap 88 on the removed children's storage container 10*c*, 10*d*, 10*e*, 10*f* or 10*g* then is moved to the opened position to provide access to the children's clothing items 22 disposed in the clothing retaining space 14 and the pocket retaining space of the selected children's storage container 10*c*, 10*d*, 10*e*, 10*f* or 10*g*. The individual or the child then dresses the child using the children's clothing items 22 from the selected children's storage container 10*c*, 10*d*, 10*e*, 10*f* or log. This process of course is repeated each morning during each day of the week.

Changes may be made in the construction and the operation of the various components, elements and assemblies of the children's storage container described herein or changes may be made in the steps or the sequence of steps of the use of the children's storage containers described herein without departing from the spirit and scope of the invention as defined in the following claims.

What is claimed is:

1. A method for organizing children's clothing items, comprising:

(a) providing a plurality of children's storage containers with each of the children's storage containers comprising a wall assembly at least partially enclosing a clothing retaining space and having an open upper end with the clothing retaining space being accessible via the open upper end, at least a portion of the wall assembly being transparent to provide a transparent portion and the clothing retaining space being visible via the transparent portion, the clothing retaining space being sized to accommodate about one outfit comprising the children's clothing items and means for removably connecting the wall assembly to a bar, wherein the step of providing the children's storage containers further comprises providing the children's storage containers with each storage container further comprising:

a bottom panel having a first end, a second end, a first side, and a second side;

a front panel having a first end, a second end, a first side, and a second side, the second side of the front panel being connected to the second side of the bottom panel;

a rear panel having a first end, a second end, a first side and a second side, the second side of the rear panel being connected to the first side of the bottom panel;

a first end panel having a first end, a second end, a first side, and a second side, the second side of the first end panel being connected to the first end of the bottom panel, the second end of the first end panel being connected to the first end of the rear panel, and the first end of the first end panel being connected to the first end of the front panel;

a second end panel having a first end, a second end, a first side and a second side, the second side of the second end panel being connected to the second end of the bottom panel, the first end of the second end panel being connected to the second end of the rear panel, the second end of the second end panel being connected to the second end of the front panel, the front panel, the rear panel, the first end panel and the second end panel each extending upwardly from the bottom panel terminating with the first sides of the front panel, the rear panel, the first end panel and the second end panel forming the open upper end, and the bottom panel, the front panels the rear panel, the front end panel and the second end panel each cooperating to form the wall assembly and cooperating to at least partially enclose the clothing retaining space;

(b) organizing the children's clothing items into separate outfits;

(c) placing each outfit in the clothing retaining space of one of the children's storage containers;

(d) removably connecting each of the children's storage containers to the bar;

(e) selecting one of the children's storage containers;

(f) removing the selected children's storage container from the bar;

(g) removing the children's clothing items from the selected children's storage container removed from the bar and dressing a child using the children's clothing items removed from the selected children's storage container removed from the bar; and (h) repeating steps (e) through (g) for dressing at different times the child in the outfits in the remaining children's storage containers.

2. The method of claim 1 wherein the step of providing the children's storage containers is defined further as providing the children's storage container with each children's storage container;

wherein the wall assembly is defined further as having a length extending between the first end panel and the second end panel, a width extending between the front panel and the rear panel and a height extending between the first side and the second side of each of the front panel, the rear panel, the first end panel and the second end panel.

3. The method of claim 2 wherein the step of providing the children's storage containers further comprises providing the children's storage containers with each of the children's storage containers comprising:

wherein the length is defined further as being in a range between about 12 inches and about 18 inches, the width is defined further as being in a range from about 2 and ½ inches to about 4 inches, and the height is defined further as being in a range from about 5 inches to about 10 inches.

4. The method of claim 1 wherein the step of providing the children's storage containers further comprises providing the children's storage containers with each of the children's storage containers comprising:

a pocket panel connected to the front panel and cooperating with a portion of the front panel to form a pocket retaining space with a pocket opening providing access to the pocket retaining space, at least a portion of the pocket panel being transparent whereby the pocket retaining space is visible via the transparent portion of the pocket panel, the pocket retaining space being sized for retaining some of the children's clothing items.

5. The method of claim 1 wherein the step of providing the children's storage containers further comprises providing the children's storage containers with each of the children's storage containers comprising:

a closure flap having a first end and a second end, the first end of the closure flap being connected to the first side of the rear panel, the closure flap being movable in an open direction to an opened position wherein the closure flap is removed from the open upper end of the wall assembly, and the closure flap being movable in a closed direction to a closed position wherein the closure flap is dimensioned to substantially encompass the open upper end; and means for removably retaining the closure flap in the closed position.

6. The method of claim 5 wherein the step of providing the children's storage containers further comprises providing the children's storage containers with each of the children's storage containers further comprising:

a pocket panel connected to the front panel and cooperating with a portion of the front panel to form a pocket retaining space with a pocket opening providing access to the pocket retaining space, at least a portion of the pocket panel being transparent whereby the pocket retaining space is visible via the transparent portion of the pocket panel, the pocket retaining space being sized for retaining some of the children's clothing items, a portion of the closure flap being dimensioned for encompassing and closing the pocket opening in the closed position of the closure flap.

7. A method for organizing children's clothing items comprising:

(a) providing between about five and about seven children's storage containers with each of the children's storage containers comprising a wall assembly at least partially enclosing a clothing retaining space and having an open upper end with the clothing retaining space being accessible via the open upper end, at least a portion of the wall assembly being transparent to provide a transparent portion and the clothing retaining space being visible via the transparent portion, the clothing retaining space being sized to accommodate about one outfit comprising the children's clothing items, and means for removably connecting the wall assembly to a bar, wherein each children's storage container comprises:

a bottom panel having a first end, a second end, a first side, and a second side;

a front panel having a first end, a second end, a first side, and a second side, the second side of the front panel being connected to the second side of the bottom panel;

a rear panel having a first end, a second end, a first side, and a second side, the second side of the rear panel being connected to the first side of the bottom panel;

a first end panel having a first end, a second end, a first side, and a second side, the second side of the first end panel being connected to the first end of the bottom panel, the second end of the first end panel being connected to the first end of the rear panel, and the first end of the first end panel being connected to the first end of the front panel;

a second end panel having a first end, a second end, a first side and a second side, the second side of the second end panel being connected to the second end of the bottom panel, the first end of the second end panel being connected to the second end of the rear panel, the second end of the second end panel being connected to the second end of the front panel, the front panel, the rear panel, the first end panel and the second end panel each extending upwardly from the bottom panel terminating with the first sides of the front panel, the rear panel, the first end panel and the second end panel forming the open upper end, and the bottom panel, the front panel, the rear panel, the first end panel and the second end panel each cooperating to form the wall assembly and cooperating to at least partially enclose the clothing retaining space;

a pocket panel connected to the front panel and cooperating with a portion of the front panel to form a pocket retaining space with a pocket opening providing access to the pocket retaining space, at least a portion of the pocket panel being transparent whereby the pocket retaining space is visible via the transparent portion of the pocket panel, the pocket retaining space being sized for retaining some of the children's clothing items; and a closure flap having a first end and a second end, the first end of the closure flap being connected to the first side of the rear panel, the closure flap being movable in an open direction to an opened position wherein the closure flap is removed from the open upper end of the wall assembly, and the closure flap being movable in a closed direction to a closed position wherein the closure flap is dimensioned to substantially encompass the open upper end;

(b) organizing the children's clothing items into outfits with each outfit to be worn by a child on a given day;

(c) moving the closure flap on each of the children's storage containers in the open direction to the opened position;

(d) placing each of the outfits in the clothing retaining space of one of the children's storage containers;

(e) closing the closure flap of each of the children's storage containers;

(f) removably connecting each of the children's storage containers to the bar in a closet; and (g) dressing the child in each of the outfits in the children's storage containers wherein each dressing of the child in one of the outfits comprises:

selecting one of the children's storage containers;

removing the selected children's storage container from the bar;

moving the closure flap of the selected children's storage container in the open direction to the opened position to provide access to the clothing retaining space via the open upper end of the children's storage container;

removing the clothing items from the clothing retaining space in the selected children's storage container; and dressing the child using the clothing items removed from the selected children's storage container.

8. A method for organizing children's clothing items comprising:

providing between about five and about seven children's storage containers with each of the children's storage containers comprising a wall assembly at least partially enclosing a clothing retaining space and having an open upper end with the clothing retaining space being accessible via the open upper end, at least a portion of the wall assembly being transparent to provide a transparent portion and the clothing retaining space being visible via the transparent portion, the clothing retaining space being sized to accommodate about one outfit comprising the children's clothing items, wherein each children's storage container comprises:

a bottom panel having a first end, a second end, a first side, and a second side;

a front panel having a first end, a second end, a first side, and a second side, the second side of the front panel being connected to the second side of the bottom panel;

a rear panel having a first end, a second end, a first side, and a second side the second side of the rear panel being connected to the first side of the bottom panel;

a first end panel having a first end, a second end, a first side, and a second side, the second side of the first end panel being connected to the first end of the bottom panel, the second end of the first end panel being connected to the first end of the rear panel, and the first end of the first end panel being connected to the first end of the front panel;

a second end panel having a first end, a second end, a first side and a second side, the second side of the second end panel being connected to the second end of the bottom panel, the first end of the second end panel being connected to the second end of the rear panel, the second end of the second panel being connected to the second end of the front panel, the front panel, the rear panel, the first end panel and the second end panel each extending upwardly from the bottom panel terminating with the first sides of the front panel, the rear panel, the first end panel and the second end panel forming the open upper end, and the bottom panel, the front panel, the rear panel, the first end panel and the second end panel each cooperating to form the wall assembly and cooperating of at least partially enclose the clothing retaining space;

a pocket panel connected to the wall assembly and cooperating with a portion of the wall assembly to form a pocket retaining space with a pocket opening providing access to the pocket retaining space, at least a portion of the pocket panel being transparent whereby the pocket retaining space is visible via the transparent portion of the pocket panel, the pocket retaining space being sized for retaining some of the children's clothing items; and a clothes hanger having a hook; and means for removably connecting the clothes hanger to the wall assembly;

organizing the children's clothing items into single outfits with each outfit to be worn by a child on a given day;

placing each of the outfits in one of the children's storage containers by placing some of the children's clothing items comprising the single outfit in the clothing retaining space, placing some of the children's clothing items comprising the single outfit in the pocket retaining space and placing some of the children's clothing items comprising the single outfit on the clothes hanger;

removably connecting each of the children's storage containers to a bar in a closet by removably connecting the hook of each of the children's storage containers to the bar;

dressing the child in each of the outfits in the children's storage containers wherein each dressing of the child in one of the outfits comprises:

selecting one of the children's storage containers;

removing the selected children's storage container from the bar;

removing the clothing items from the clothing retaining space and from the pocket retaining space and from the hanger of the selected children's storage container; and dressing the child using the clothing items removed from the selected children's storage container.

9. The method of claim 8 wherein the step of providing the children's storage containers is defined further as providing the children's storage container with each children's storage container;

wherein the wall assembly is defined further as having a length extending between the first end panel and the second end panel, a width extending between the front panel and the rear panel and a height extending between the first side and the second side of each of the front panel, the rear panel the first end panel and the second end panel.

10. The method of claim 9 wherein the step of providing the children's storage containers further comprises providing the children's storage containers with each of the children's storage containers comprising:

wherein the length is defined further as being in a range between about 12 inches and about 18 inches, the width is defined further as being in a range from about 2 and ½ inches to about 4 inch, and the height is defined further as being in a range from about 5 inches to about 10 inches.

11. The method of claim 8 wherein the step of providing the children's storage containers further comprises providing the children's storage containers with each of the children's storage containers comprising:

a closure flap having a first end and a second end, the first end of the closure flap being connected to the first side of the rear panel, the closure flap being movable in an open direction to an opened position wherein the closure flap is removed from the open upper end of the wall assembly, and the closure flap being movable in a closed direction to a closed position wherein the closure flap is dimensioned to substantially encompass the open upper end; and means for removably retaining the closure flap in the closed position.

12. A method for organizing children's clothing items comprising:

(a) providing between about five and about seven children's storage containers with each of the children's storage containers comprising a wall assembly at least partially enclosing a clothing retaining space and having an open upper end with the clothing retaining space being accessible via the open upper end, at least a portion of the wall assembly being transparent to provide a transparent portion and the clothing retaining space being visible via the transparent portion, the clothing retaining space being sized to accommodate about one outfit comprising the children's clothing items, and means for removably connecting the wall assembly to a bar, wherein each children's storage container comprises:

a bottom panel having a first end, a second end, a first side, and a second side;

a front panel having a first end, a second end, a first side, and a second side, the second side of the front panel being connected to the second side of the bottom panel;

a rear panel having a first end, a second end, a first side, and a second side, the second side of the rear panel being connected to the first side of the bottom panel;

a first end panel having a first end, a second end, a first side, and a second side, the second side of the first end panel being connected to the first end of the bottom panel, the second end of the first end panel being connected to the first end of the rear panel, and the first end of the first end panel being connected to the first end of the front panel;

a second end panel having a first end, a second end, a first side and a second side, the second side of the second end panel being connected to the second end of the bottom panel, the first end of the second end panel being connected to the second end of the rear panel, the second end of the second end panel being connected to the second end of the front panel, the front panel, the rear panel, the first end panel and the second end panel each extending upwardly from the bottom panel terminating with the first sides of the front panel, the rear panel the first end panel and the second end panel forming the open upper end, and the bottom panel, the front panel, the rear panel the first end panel and the second end panel each cooperating to form the wall assembly and cooperating to at least partially enclose the clothing retaining space;

(b) organizing the children's clothing items into outfits with each outfit to be worn by a child on a given day;

(c) placing each of the outfits in the clothing retaining space of one of the children's storage containers;

(d) removably connecting each of the children's storage containers to the bar in a closet; and (e) dressing the child in each of the outfits in the children's storage containers wherein each dressing of the child in one of the outfits comprises:

selecting one of the children's storage containers;

removing the selected children's storage container from the bar; clothing removing the clothing items from the retaining space in the selected children's storage container; and dressing the child using the clothing items removed from the selected children's storage container.

* * * * *

UNITED STATES PATENT AND TRADEMARK OFFICE

CERTIFICATE OF CORRECTION

PATENT NO. : 5,370,230

DATED : December 6, 1994

INVENTOR(S) : Lisa C. Cox

It is certified that error appears in the above-identified patent and that said Letters Patent is hereby corrected as shown below:

Column 1, line 32, insert-- Fig. 6 is a block diagram of the method used in the present invention.--

Column 2, line 5, after the word "as" please delete ",".

Column 2, line 41, after the word "week" please delete ",".

Column 3, line 5, please delete "shogun" and substitute therefor -- shown --.

Column 3, line 17, please delete "Shown" and substitute therefor -- shown --.

Column 5, line 20, please delete "provides" and substitute therefor -- provide --.

Column 5, line 26, please delete "As mentioned before," and substitute therefor -- Referring to FIGS. 5 and 6, --.

Column 6, line 6, please delete "With" and substitute therefor -- with --.

Column 6, line 20, please delete "24" and substitute therefor -- 18 --.

UNITED STATES PATENT AND TRADEMARK OFFICE

CERTIFICATE OF CORRECTION

PATENT NO. : 5,370,230

DATED : December 6, 1994

INVENTOR(S) : Lisa C. Cox

It is certified that error appears in the above-identified patent and that said Letters Patent is hereby corrected as shown below:

Column 6, line 29, please delete "log" and substitute therefor -- 10g --.

Column 7, line 23, please delete "panels" and substitute therefor -- panel, --.

Column 7, line 25, after the word "panel" please insert -- , --.

Column 9, line 26, after the word "panel" please insert -- , --.

Column 10, line 58, after the word "panel" please insert -- , --.

Column 10, line 59, please delete "of" and substitute therefor -- to --.

Column 11, line 42, after the word "panel" at the beginning of the line please insert -- , --.

Column 12, line 44, after "the rear panel" insert -- , --. please insert -- , --.

Column 12, line 47, after the word "panel" at the beginning of the line please insert -- , --.

UNITED STATES PATENT AND TRADEMARK OFFICE

CERTIFICATE OF CORRECTION

PATENT NO. : 5,370,230

DATED : December 6, 1994

INVENTOR(S) : Lisa C. Cox

It is certified that error appears in the above-identified patent and that said Letters Patent is hereby corrected as shown below:

Column 12, line line 48, after the word "panel" please insert -- , --.

Column 12, line 62 , at the end of the line please delete "clothing".

Column 12, line 63 , before the word "retaining" please insert -- clothing --.

Signed and Sealed this

Ninth Day of May, 1995

Bruce Lehman

*Attest:*

BRUCE LEHMAN

*Attesting Officer*

*Commissioner of Patents and Trademarks*